United States Patent [19]

Fuller et al.

[11] 4,296,389

[45] Oct. 20, 1981

[54] CRIMPED COAX REFLECTIVE DISPERSIVE DELAY LINE

[75] Inventors: Harrison W. Fuller, Lexington, Mass.; Chester E. Stromswold, Nashau, N.H.

[73] Assignee: Sanders Associates, Inc., Nashua, N.H.

[21] Appl. No.: 39,229

[22] Filed: May 14, 1979

[51] Int. Cl.[3] ..... H01P 1/202; H01P 3/06; H01P 9/00; H01P 11/00

[52] U.S. Cl. ..... 333/160; 29/600; 333/23; 333/206; 333/245

[58] Field of Search ..... 333/156, 160, 206, 138-140, 333/245, 19, 20, 23, 18, 236, 243-244; 174/26, 126 R, 102; 29/600, 624

[56] References Cited

U.S. PATENT DOCUMENTS

| | | | |
|---|---|---|---|
| 3,317,830 | 5/1967 | Winninstad | 333/160 X |
| 3,349,479 | 10/1967 | Sewell | 29/600 |
| 3,422,378 | 1/1969 | La Rosa | 333/28 |
| 3,452,429 | 7/1969 | Liebscher | 333/243 X |
| 3,530,408 | 9/1970 | Brandon et al. | 333/28 |
| 3,711,942 | 1/1973 | Reynolds | 333/260 X |

OTHER PUBLICATIONS

Montgomery et al.-Principles of Microwave Circuits, McGraw-Hill, New York, 1948, title page and pp. 187-189.

Ragan-Microwave · Transmission Circuits, McGraw-Hill, New York, 1958, title page and pp. 184-188.

Microwave Transmission Design Data, Publication No. 23-80, Sperry Gyroscope Co., Great Neck, L.I., Scientific Library Acquisition Date May 9, 1966, title pages (2) and pp. 46-53.

Terman-Electronic and Radio Engineering, McGraw-Hill, New York, Fourth Edition, 1955, title page and pp. 119-123.

*Primary Examiner*—Marvin L. Nussbaum

*Attorney, Agent, or Firm*—Louis Etlinger; Ronald Reichman

[57] ABSTRACT

A dispersive delay line and method for fabricating the delay line is described in which coaxial cable is utilized and in which the dispersive or bandpass characteristic is established by the crimping of the coaxial cable in such a manner that the axial crimp length is small compared to the wavelength, thereby providing a discontinuity which behaves like a simple shunt capacity. A simple fabrication technique is utilized in which the crimps are applied to the line at selected points by use of a four-tooth crimping tool.

12 Claims, 14 Drawing Figures

TUBE CUTTING TOOL

CRIMPED COAX REFLECTIVE DISPERSIVE DELAY LINE

FIELD OF INVENTION

This invention relates to dispersive delay lines and/or bandpass filters and more particularly to improvements in a broadband dispersive delay line achieved by the crimping of a conventional coaxial cable.

BACKGROUND OF THE INVENTION

Dispersive delay lines have been utilized in the past for many purposes such as compression filters which compress signals by making the delay of the signal applied to the line proportional to frequency or alternatively, as a chirp local oscillator which generates an output signal whose frequency rapidly sweeps through a given band. One of the most popular uses for the dispersive delay line is in compressive receivers, in which the presence and frequency of an incoming signal is ascertained by heterodyning the incoming signal with a fast-sweeping variable frequency oscillator signal. The dispersive delay line compresses the resulting signal and its output when sampled at a particular time shows the existence of a signal at a predetermined frequency.

For purposes of this invention a dispersive delay line is a network arranged so that signals at the low end of a given band are delayed $\tau_1$ seconds, and the signals at the high end of the band are delayed $\tau_2$ seconds, with a linear relationship in between:

$$\frac{\tau - \tau_1}{\tau_2 - \tau_1} = k\frac{f - f_L}{f_U - f_L}$$

The result is that for a frequency sweep matched to the frequency is delay characteristic of the line, the low frequency part of the signal emerges from the network simultaneously with the high frequency part, and indeed all frequency components of a signal emerge simultaneously.

In the past, there have been a number of different dispersive delay line techniques. One delay line is called a "meander line" and was developed and used by the Stanford Research Institute in their pioneering microscan receiver developments for the U.S. Air Force and U.S. Army. The meander line was a delay line consisting of bridged T microwave sections which were planar in structure. While excellent early results were obtained with the meander line, which included a 600 MHz bandwidth and a 200 nanosecond differential delay, this particular type of line is difficult to fabricate and expensive to manufacture.

More recently, surface acoustic wave (SAW) devices have been utilized in pulse-compression. In 1976, R. D. Weglein et al, of Hughes, reported a 500 MHz bandwidth surface wave pulse compressive filter operating about a center frequency of 1.3 GHz. Mellon and Bell of Texas Instruments described the development of a UHF surface wave pulse compressor, which device was designed to operate between 1.0 and 1.5 GHz. Also in the same year, Williamson et al presented a paper on "L-Band Reflective Array Compressor with a Compression Ratio of 5120." Weglein's line used electron beam fabrication as did that of Mellon and Bell. Williamson's line was a reflective array compressor utilizing ion beam etching for pattern generation.

In most instances, the reflective array compressor lines are fabricated on lithium niobate and BGO. Here, the bandwidth is resolution limited at about 500 MHz.

Limits of high frequency operation of SAW devices, whether they use interdigitated finger patterns, reflective grooves, or combinations of these, depends upon the ability to accurately produce the pattern to be manufactured on the required substrate. At the present time, SAW State-of-the-Art technology appears to be progressing towards a practical 1 GHz bandwidth filter.

One family of dispersive delay lines not heretofore mentioned, are the magnetostatic wave delay lines. The principle of operation of these delay lines depends on continuous, inherent dispersive properties of the delay medium that potentially eliminates the need for high resolution transducer patterns. At the same time, the propagation velocity is low enough to design small devices. Both magnetostatic surface wave results and bulk wave results show promise of very high frequency operation from several GHz to tens of GHz. However, these particular lines have excessive insertion loss and an excessive latency time for purposes of high performance pulse compression receivers.

As compared to the State-of-the-Art compressive filters, a compressive filter can by the present teaching be fabricated from a simple conventional "semi-rigid" 50 ohm coaxial cable, in which the cable is provided with discontinuities at predetermined spaced intervals, which discontinuities reflect energy of a predetermined frequency back through the line by virtue of the spacing between the discontinuities. In one embodiment this is accomplished by a technique in which the outer conductor is crimped inwardly at selected points to provide a single port device which has a wider bandwidth than the SAW devices with lower insertion loss. When the axial crimp length is small compared to the wavelength, the crimped portion behaves as a simple capacitive shunt to reflect incoming energy back down the line, selectively by frequency as a function of crimp spacings. For purposes of this invention "crimping" refers to the compressing or pinching of the outer conductor of the coaxial line towards the inner conductor. In conventional "semi-rigid" coaxial lines the outer conductor is copper or steel.

At the present time, with the crimp coax technique, it is possible to obtain a demonstrable pulse compression bandwidth of up to 3.6 GHz and low insertion loss in a single line. Other features are a single port, 50 ohm impedance and insensitivity to temperature changes, and further automatic temperature compensation by forming the linear-FM swept local oscillator by impulsing a crimped line of similar design. The crimping is accomplished by a crimping tool which in one embodiment has four teeth which squeeze into the line to provide the capacitative shunt. Alternatively, the line may be compressed at the required point by parallel spaced apart blades in a scissors-like pinch action, or by a pipe-cutting type tool which crimps the line symmetrically into an annular groove.

It should be noted that the use of a coaxial cable as a delay line is not without precedent. The simple, reliable wideband "uncrimped" coaxial cable delay line has been in use for over twenty years in many thousands of repeater jammers as a microwave memory element. No other device (bulk acoustic, SAW or meander line) has proven as economical in this application when large bandwidth and low loss are required.

It is, therefore, the purpose of this invention to take an extremely reliable mass produced product, whose properties are well known and provide reflective, crimped coax capacitive shunts therein so as to provide a wide bandwidth dispersive delay line which is compact and low cost. The crimped coax dispersive delay line is a single port device which may be easily and inexpensively mass produced with a precisely controlled characteristic impedance of 50 ohms thus requiring no matching networks, and with a low temperature coefficient of delay which eliminates the need for temperature control. Independent crimping for amplitude weighting and linear time delay corrections is accomplished within the line and the compact structure needs no shielding or special packaging.

It should be noted, moreover, that the subject dispersive delay line may be used in one or both of two modes: (1) as a compressive filter for use with compressive receivers and (2) as a chirp local oscillator which, when fed with a short impulse signal effectively having all frequency components, produces sequentially signals differing in frequency so as to provide a sweep or chirp local oscillator signal at its output.

It will be appreciated that the subject invention has been described in terms of a dispersive delay line in which the delay is a linear function of frequency. The crimped coaxial line may also be configured to function as a bandpass filter. In one embodiment, with equally spaced crimps, the filter has a $$\frac{\sin x}{x}$$

characteristic. Alternatively, with appropriate amplitude and phase weighting, the line can be tailored to a desired bandpass characteristic involving a predetermined sidelobe structure. It will be appreciated that the amplitude weighting is a function of the depth of the crimp, and the phase is a function of crimp positioning. It should be noted that bandpass filters have been made in the past from waveguides provided with spaced stubs. This is however an expensive process and the crimped coaxial line offers significant cost advantages as well as certain performance advantages. Also due to the flexibility of the crimped coaxial line, packaging dimensions can be minimized with the coiling of the lines.

It is, therefore, an object of this invention to provide a unique, dispersive delay line with wide bandwidth and which is simply and easily fabricated from standard, coaxial cable.

It is an object of this invention to provide a unique bandpass filter made by crimping standard coaxial cable.

It is another object of this invention to provide a dispersive delay line in which inexpensive crimping is utilized to give the coaxial line a dispersive characteristic.

It is another object of this invention to provide a method of fabricating a dispersive delay line which involves the crimping of conventional, coaxial cable.

It is a yet still further object of this invention to provide a dispersive delay line by providing a series of discontinuities in a conventional coaxial cable.

These and other objects will be better understood when viewed in light of the following description taken in conjunction with the following drawings:

DETAILED DESCRIPTION

Figure 1:
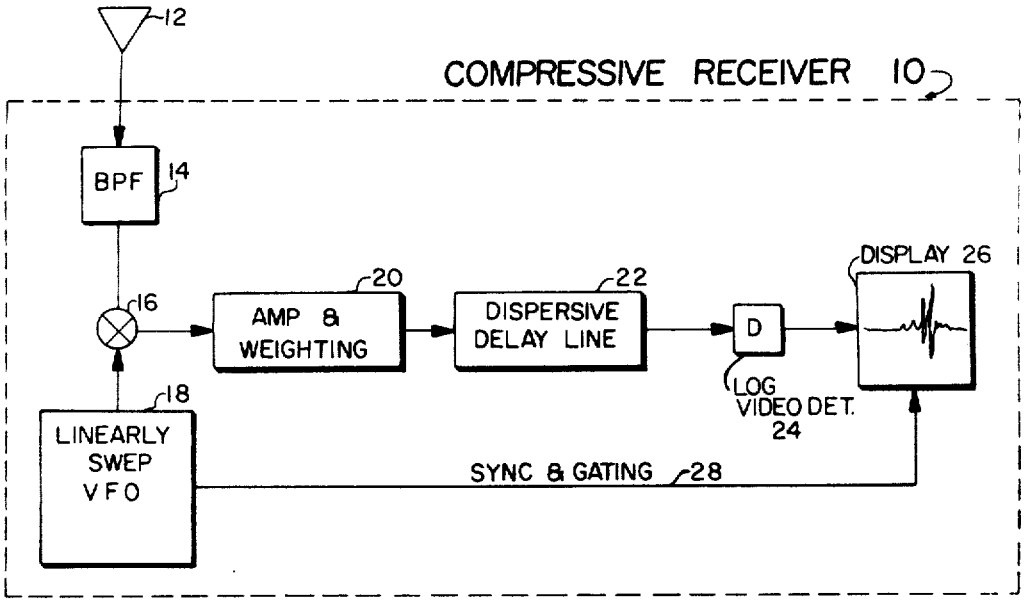
FIG. 1 is a diagrammatic representation of a conventional compressive receiver utilizing a dispersive delay line.

Since the subject line is most popularly utilized in compressive receivers, a conventional compressive receiver is now described. Conventional compressive receivers such as that illustrated in FIG. 1 by reference character 10, in general comprise an antenna 12 which is coupled to a bandpass filter 14 which is in turn coupled to mixer 16 which mixes a linearly swept, variable frequency oscillator 18 signal with the incoming signal. This results in a heterodyned signal which is applied to a conventional amplitude spectral weighting circuit 20, the output of which is applied to a dispersive delay line 22. The purpose of the spectral weighting circuit is to time compress the input signal. The output signal of the dispersive delay line is under ordinary circumstances detected by a linear or log video detector 24 and is displayed conventionally on a CRT or other type display 26, such that with appropriate synchronization and gating pulses applied on line 28, the existence and frequency of an incoming signal may be determined.

As will be appreciated, the compressive receiver is utilized to simultaneously scan a band of incoming signals and to determine the existence or presence of an incoming signal of a given frequency, or multiple incoming signals of different frequency. The larger the bandwidth of the dispersive delay line, the larger the band that the compressive receiver can sweep, and therefore, the more useful the compressive receiver in terms of detecting incoming signals. Conversely, if the band which is swept is kept the same, the higher the bandwidth of the dispersive delay line, the more information which can be obtained by increased resolution of each "frequency bin". Thus, the bandwidth of the dispersive delay line plays a crucial role in the operation of the compressive receiver and its ability to operate either at higher and higher resolution or concomitantly with faster sweeping local oscillators. Of more basic importance is the "time bandwidth product" which is roughly equal to the reciprocal of the fractional resolution.

As mentioned hereinbefore, SAW devices have been utilized traditionally as the dispersive delay line element. When used in a compressive receiver, the dispersive delay line acts as a compressive filter. However, it should be noted that the dispersive delay line may act in the manner of a swept local oscillator or chirped local oscillator by merely applying a short impulse to the input thereof.

Figure 2:
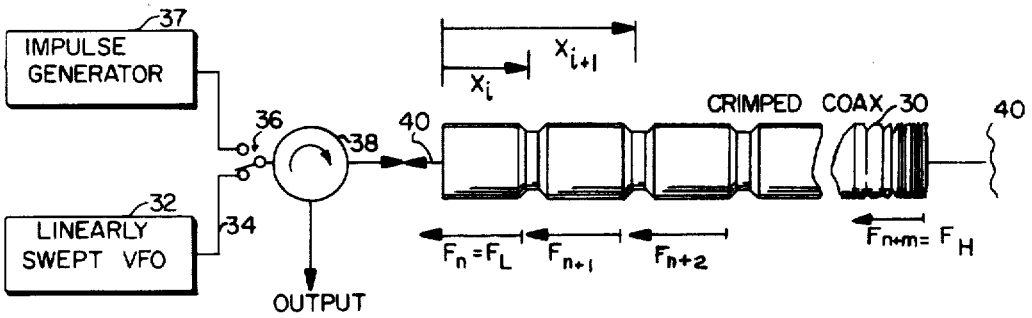
FIG. 2 is a diagrammatic representation of a dispersive delay line formed from the crimping of conventional, "semi-rigid" coaxial cable.

The subject invention, as illustrated in FIG. 2, shows the utilization of a conventional semi-rigid coaxial cable 30 which may be type UT-141, sometimes known as microcoax. The coax may have a solid outer conductor, teflon insulation and either a copper or copper coated steel inner conductor. The coax length may extend for as much as 70 feet and is therefore usually coiled and potted after the crimping, to be described hereinafter. As illustrated in FIG. 2, in the compressive filter mode, a swept frequency signal generator 32 such as described in U.S. Pat. No. 3,382,460 issued to D. Blitz et al on May 7, 1968, has an output 34 applied through switch 36 to a directional circulator 38 and thence to the input port 40 of the crimped coax line 30. Alternatively, in a chirp local oscillator (LO) mode, an impulse generator 37 using for example a step recovery diode such as Hewlett Packard HP 5082-0802 in conjunction with a $\lambda/4$stub, is coupled via switch 36 to the directional coupler. This device is designed to generate a single sinusoid at the center frequency of the compressive line. The output in this mode is a linear-swept FM sinusoid starting at $f_L$ and rising linearly to $f_U$ in one line roundtrip time.

As can be seen, the crimped coax line is terminated conventionally at 42, with crimps designated $f_n$, $f_{n+1}$, $f_{n+2} \ldots f_{n+m}$ denoting the region at which signals at these frequencies are primarily reflected back through the crimped coaxial line.

Figure 3:
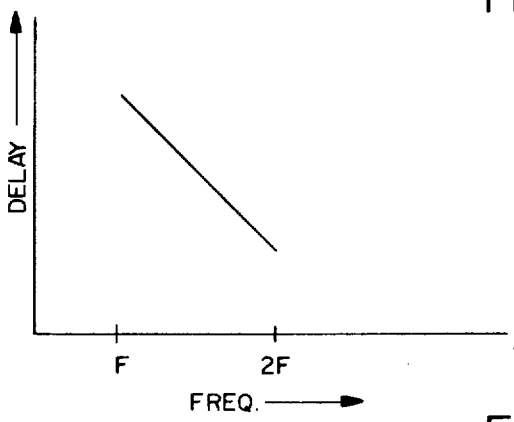
FIG. 3 is a diagram showing delay as a function of frequency for the delay line of FIG. 2, in which the line operates over a frequency band of less than an octave.

It will be appreciated that due to the nature of capacitive shunts within a localized region of the line, it takes a number of equally spaced crimps to reflect energy back at a given frequency. These crimps can be conceived of as a subset of the crimps illustrated, in that the average spacing in this small section of line is the correct spacing for the particular frequency denoted by the characters $f_n$, $f_{n+1}$, etc. The notation in FIG. 2 is therefore merely a schematic representation on a macroscopic level of the function of the line. In the illustrated case, the low frequency end of the coax is at the left-hand end and the high frequency end of the coax is at the righthand end, as designated by $f_L$ and $f_H$. The delay versus frequency of the coax line is linear as illustrated by FIG. 3 and the placement of the crimps, in one embodiment, is dictated by the following generalized formula:

Starting at the low-frequency end of the line, the recurrence relationship used in calculating crimp position is:

$$x_{i+1} = x_i + \frac{Kc/2f_L}{1 + x_i\left(\frac{f_H - f_L}{f_L L}\right)}$$

Where $c$ is the speed of light; $x_i$ is a reflector position along a line; $K$ is the fractional velocity $\epsilon^{-\frac{1}{2}}$ caused by a coax dielectric medium of dielectric constant $\epsilon = 2$; and $L$ is the total length of the line.

The frequency of the signal reflected in the region of a given crimp is given by:

$$f(x) = \frac{x}{L}(f_H - f_L) - f_L$$

Figure 4:
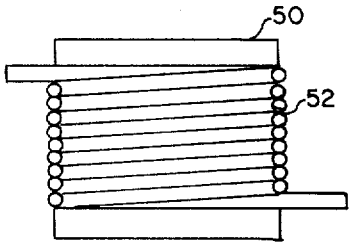
FIG. 4 is a plan view of a crimped coax delay line coiled about a spool.

As illustrated in FIG. 4, once the coaxial line has been crimped at the appropriate places, it may be wound on a spool 50 so as to accomodate the long length of line required for the dispersive delay. In this case, the line is illustrated as being helically coiled at 52 although the line may be coiled on itself in a single plane (not shown). The benefit of the flat coil configuration is that a number of lines, both compression and chirp, can be packaged together and maintained at the same temperature to maintain matched compression and chirp characteristics.

Figure 5:
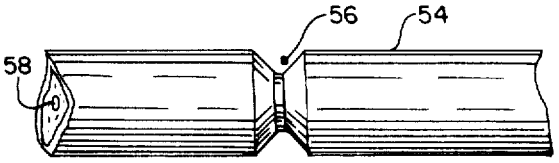
FIG. 5 is a plan view of a portion of a crimped coaxial cable which is annularly crimped.
Figure 6A:
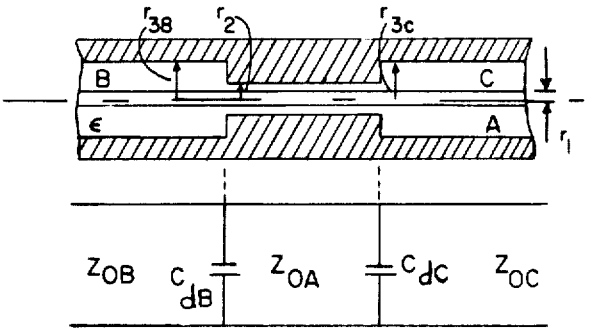
FIGS. 6A and 6B illustrated the capacity shunt provided by the discontinuity involved in the crimping process, describing in a general manner first a fairly long sized crimp and then illustrating a fairly short sized crimp.
Figure 6B:
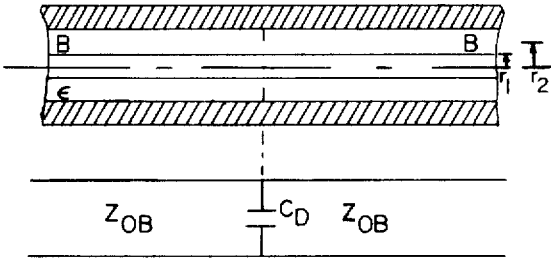

An annular crimped portion of the coax is shown in FIG. 5 in which the outer conductor 54 is crimped inwardly as shown at 56 towards the central conductor 58, a portion of which is shown. This may be accomplished by a conventional rolling-wheel tube cutter 60 shown in FIG. 8 having a wheel edge rounded to a 10 mil radius of curvature. The equivalent circuits for an idealized coaxial line discontinuity are shown in FIGS. 6A and 6B and which indicate that assuming a crimped discontinuity which is axially sufficiently short, discontinuities behave like a simple shunt capacity as shown at the bottom of FIG. 6B. It can be shown that $C_{dB}$ is approximately equal to: $2\pi\ r_1\ \epsilon\ C'_{d2}$ $$\left(\frac{a}{b}, \frac{r_{3B}}{r_1}\right)$$

and that $C_{dC}$ is approximately equal to $2\pi\ r_1\ \epsilon\ C'_{d2}$ $$\left(\frac{a}{c}, \frac{r_{3C}}{r_1}\right),$$

where a is equal to $r_2 - r_1$, b is equal to $r_{3B} - r_1$ and c is equal to $r_{3C} - r_1$. Here $C'_{d2}$ is the discontinuity capacitance divided by inner circumference as described in the Proceedings of the IRE, November 1944, p. 695 at p. 699, entitled Coaxial-Line Discontinuities by Whinnery, Jamieson and Robbins, incorporated herein by reference.

By recognizing that the discontinuity is axially short, the capacitance $C_d$ is approximately equal to $4\pi\ r_1\ \epsilon\ C'_{d2}$ $$\left(\frac{a}{b}, \frac{r_3}{r_1}\right)$$

where a is equal to $r_2-r_1$; b is equal to $r_3-r_1$. $C'_{d2}$ can be determined by the graph of FIG. 10 of the above-identified article at page 699. Knowing this, it is a simple matter to calculate the placement and depth of the crimp.

Light, Medium and Heavy Crimps

In one embodiment $C_d$ equaled 0.00474 $\mu\mu$fd for a light crimp. It will be apparent that some axial elongation occurs during heavy crimping and demands that this elongation be considered in the crimp distribution for a precision line design. A second-order amplitude and phase correction is available by very light crimps placed between initial crimps for fine tuning amplitude and phase corrections of the measured line. The elongation effects of these light crimps can be ignored. Amplitude corrections are made midway between the heavy crimps to produce a 180° phase reflection, thus affecting amplitude and not phase. Phase corrections that leave amplitude response undisturbed are made at ¼ or ¾ positions between crimps, depending on whether a positive or negative phase correction is required.

The capacity of a heavy shunt can be calculated by scaling the three radii to the 85 mil outer diameter of the line such that $r_1=10.6$ mils; $r_2=16$ mils and $r_3=31.9$ mils. From the above equations, a=6.2 mils, b=21.3 mils, a/b=0.291 and $r_3/r_1=3.01$. $C_d$ therefore=0.036 $\mu\mu$fd where $\epsilon=2$ is assumed for a Teflon insulation. r refers to mean effective radius.

If a design center frequency of 6 GHz is chosen a shunt capacity of 0.036 $\mu\mu$fd has a reactance of $$|X_c(6.0)| \doteq \left|\frac{i}{2\pi f C_d}\right| = 736 \text{ ohms.}$$

The reflection coefficient of such a reflector in a 50 ohm line is roughly 0.068 with a phase shift of 87.7 degrees in a nine crimp line with a physical elongation of about 7 mils per crimp accounting for about a 0.7% physical elongation of the line for a factor of 0.993; and an additional RC delay produced by the 50 ohm line impedance and the 736 ohm capacitive reactance (each ½ wavelength) results in a phase delay of tan $^{-1}$ (50/736) or 87.7°. Thus the frequency shift of the structure is 0.021 fractionally, for a frequency factor of 0.979. The theoretically corrected center frequency for the line is thus $f_c=5.83$ GHz in one embodiment. The peak response insertion loss in one experimental embodiment was 4.5 db, which was well within experimental error.

While the response of the 9-reflector filter should be approximately $$\frac{\sin x}{x}$$

in form, it is clear that the high frequency sidelobe exceeds the low. This asymmetry results from two 6 dB per octave effects: the linear increase in (small) reflection coefficient (for a capacitive shunt) with frequency, and the number of reflectors per incremental frequency interval that increases linearly with frequency. From both theoretical and experimentally confirmed results, reflection capacity of 0.036 $\mu\mu$fd can be utilized for the deep crimp situation. The same analysis yields capacities for the medium and light crimps such that for the medium crimp $r_1=10.6$ mils, $r_2=23.3$ mils, $r_3=31.9$ mils, a=10.7 mils, b=21.3 mils, $$\frac{a}{b} = 0.502, \frac{r_3}{r_1} = 3.01.$$

The capacity for the light crimp is found from $r_1=10.6$ mils, $r_2=26.6$ mils, $r_3=31.9$ mils, a=16.0 mils, b=21.3 mils, $$\frac{a}{b} = 0.751, \frac{r_3}{r_1} = 3.01,$$

$C_d=4\pi r_1 \epsilon C'_{d2}(a,\tau)=0.00474$ $\mu\mu$fd.

It is therefore straightforward to achieve a ten-to-one range of crimp reflection coefficients which is sufficient to permit building amplitude weighting directly into the line.

In one operative example, the crimp locations for an experimental line having a 6.0 GHz center frequency and 3.6 HGz bandwidth are given in Table I hereinbelow:

TABLE I

| i | $x_i$ (Inches) | $x_i - x_{i-1}$ (Inches) | i | $x_i$ (Inches) | $x_i - x_{i-1}$ (Inches) | i | $x_i$ (Inches) | $x_i - x_{i-1}$ (Inches) |
|---|---|---|---|---|---|---|---|---|
| 0 | 0 | — | 32 | 26.87099925 | 0.7313713488 | 64 | 47.99814039 | 0.604988552 |
| 1 | 0.9842519686 | 0.9842519686 | 33 | 27.59715055 | 0.7261512957 | 65 | 48.60016764 | 0.6020272526 |
| 2 | 1.955854445 | 0.971602476 | 34 | 28.31819225 | 0.7210416999 | 66 | 49.19927673 | 0.5991090856 |
| 3 | 2.915284902 | 0.9594304572 | 35 | 29.03423097 | 0.7160387152 | 67 | 49.79550974 | 0.596233014 |
| 4 | 3.86299144 | 0.9477065379 | 36 | 29.74536965 | 0.7111386798 | 68 | 50.38890777 | 0.5933980336 |
| 5 | 4.799395262 | 0.9364038217 | 37 | 30.45170776 | 0.7063381059 | 69 | 50.97951094 | 0.5906031744 |
| 6 | 5.724892881 | 0.9254976185 | 38 | 31.5334143 | 0.7016336695 | 70 | 51.56735844 | 0.5878474987 |
| 7 | 6.639858106 | 0.9149652246 | 39 | 31.85036363 | 0.6970221995 | 71 | 52.15248854 | 0.5851300978 |
| 8 | 7.544643821 | 0.9047857149 | 40 | 32.5428643 | 0.6925006706 | 72 | 52.73493863 | 0.5824500931 |
| 9 | 8.439583596 | 0.8949397748 | 41 | 33.23093049 | 0.6880661922 | 73 | 53.31474526 | 0.5798066348 |
| 10 | 9.324993134 | 0.8854095379 | 42 | 33.91464649 | 0.6837160036 | 74 | 53.89194416 | 0.5771988977 |
| 11 | 10.2011758 | 0.876178450 | 43 | 34.59409395 | 0.6794474644 | 75 | 54.46657024 | 0.5746260848 |
| 12 | 11.06840273 | 0.8672311515 | 44 | 35.2693520 | 0.6752580491 | 76 | 55.03865766 | 0.5720874223 |
| 13 | 11.9269561 | 0.8585533656 | 45 | 35.94049734 | 0.6711453394 | 77 | 55.60823982 | 0.5695821605 |
| 14 | 12.7770879 | 0.8501318017 | 46 | 36.60760436 | 0.6671070209 | 78 | 56.17534939 | 0.5671095735 |
| 15 | 13.61904197 | 0.8419540702 | 47 | 37.27074523 | 0.6631408744 | 79 | 56.74001835 | 0.5646689552 |
| 16 | 14.45305058 | 0.8340086065 | 48 | 37.92999000 | 0.6592447734 | 80 | 57.30227797 | 0.5622596235 |
| 17 | 15.27933518 | 0.8262845996 | 49 | 38.58540668 | 0.655416678 | 81 | 57.86215888 | 0.5598809143 |
| 18 | 16.09810711 | 0.8187719317 | 50 | 39.23706131 | 0.6516546297 | 82 | 58.41969106 | 0.557532184 |
| 19 | 16.90956823 | 0.8114611217 | 51 | 39.88501806 | 0.6479567488 | 83 | 58.97490387 | 0.555212807 |
| 20 | 17.7139115 | 0.8043432729 | 52 | 40.52933929 | 0.6443212301 | 84 | 59.52782605 | 0.5529221777 |
| 21 | 18.51132153 | 0.7974100288 | 53 | 41.17008563 | 0.6407463381 | 85 | 60.07848576 | 0.5506597053 |
| 22 | 19.30197506 | 0.7906535328 | 54 | 41.80731603 | 0.637230406 | 86 | 60.62691058 | 0.5484248185 |
| 23 | 20.08604145 | 0.7840663885 | 55 | 42.44108785 | 0.6337718243 | 87 | 61.17312754 | 0.5462169595 |
| 24 | 20.86368308 | 0.7776416262 | 56 | 43.0714569 | 0.6303690538 | 88 | 61.71716313 | 0.5440355884 |
| 25 | 21.63505575 | 0.7713726712 | 57 | 43.69847751 | 0.6270206064 | 89 | 62.25904331 | 0.5418801788 |

TABLE I-continued

| i | $x_i$ (Inches) | $x_i - x_{i-1}$ (Inches) | i | $x_i$ (Inches) | $x_i - x_{i-1}$ (Inches) | i | $x_i$ (Inches) | $x_i - x_{i-1}$ (Inches) |
|---|---|---|---|---|---|---|---|---|
| 26 | 22.40030907 | 0.7652533157 | 58 | 44.32220256 | 0.6237250503 | 90 | 62.79879353 | 0.5397502196 |
| 27 | 23.15958677 | 0.7592776958 | 59 | 44.94268357 | 0.6204810062 | 91 | 63.33643874 | 0.5376452135 |
| 28 | 23.91302703 | 0.753440261 | 60 | 45.55997071 | 0.6172871441 | 92 | 63.87200342 | 0.5355646766 |
| 29 | 24.66076279 | 0.7477357595 | 61 | 46.17411289 | 0.6141421827 | 93 | 64.40551156 | 0.5335081385 |
| 30 | 25.4029220 | 0.7421592137 | 62 | 46.78515778 | 0.6110448855 | 94 | 64.9369867 | 0.5314751403 |
| 31 | 26.1396279 | 0.7367059029 | 63 | 47.39315184 | 0.6079940592 | | | |

Figure 7A:
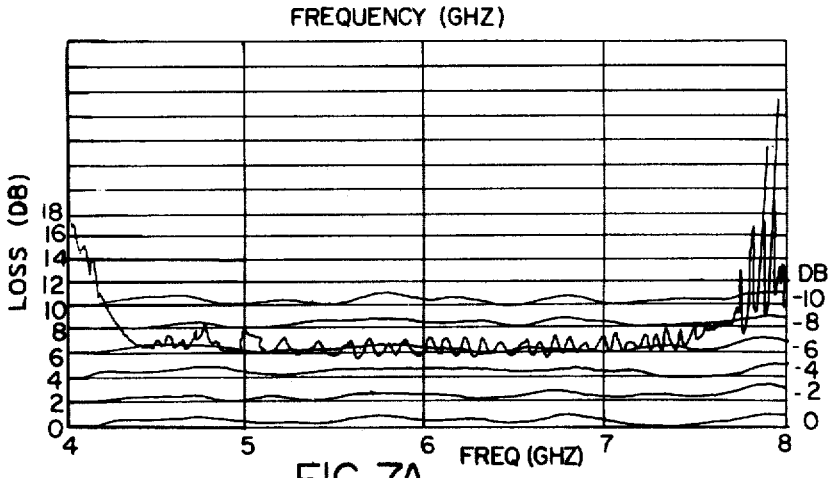
FIGS. 7A and 7B show expanded results of one crimped coax line in terms of amplitude and phase response.

FIG. 7A illustrates the experimental amplitude response of a crimped cable formed with uniform crimp depth in accordance with the crimp locations indicated in Table I. Note the flatness of the response over the 3.6 GHz passband for this embodiment.

Figure 7B:
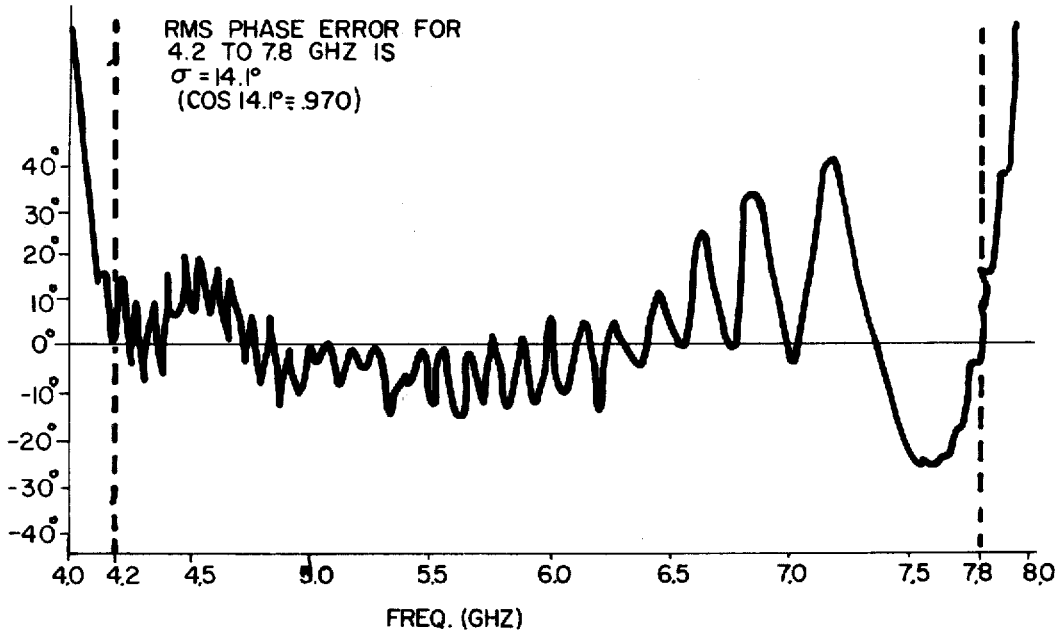

FIG. 7B shows phase deviation for the above experimental line indicating an RMS phase deviation from an ideal quadrature characteristic of 140 which is within 3% of an ideal line.

CONSTRUCTION OF THE CRIMPED LINE

Figure 8:
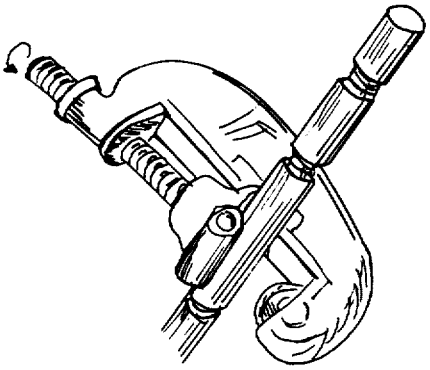
FIG. 8 shows a tube cutting tool which is used to provide the crimp in the coaxial line of FIG. 5.
Figure 9:
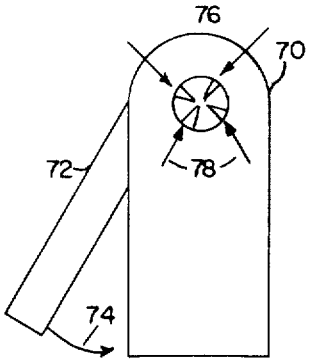
FIG. 9 is a diagrammatic representation of a four-tooth crimping tool which provides for capacitive shunt discontinuities in a conventional coaxial cable.

While the crimping operation can be accomplished with a conventional rolling wheel tube cutter 60 such as shown in FIG. 8, the crimping can also be accomplished with a conventional four-toothed crimping device 70 such as Model MS 27831 manufactured by the Daniels Manufacturing Company. This crimping device, in one embodiment, was modified by removing the second set of teeth which exist immediately behind the first set of teeth. As can be seen from FIG. 9, a handle portion 72 may be moved in the direction of arrow 74 such that the teeth 76 move in the direction of the arrows 78. The depth of the crimp determines the shunt capacitance as outlined above.

Figure 10A:
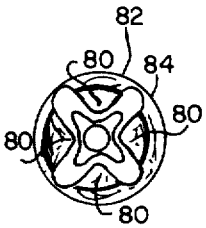
FIGS. 10A and 10B show respectively in cross section and plan view the result of the utilization of the crimping tool of FIG. 9.

The utilization of standard 85 mil coax and the crimping device results in a crimp of the coaxial line such as shown in cross section in FIG. 10A. The crimped portions are indicated by reference character 82 and the uncrimped portion of the outer conductor indicated by reference character 84.

Figure 10B:
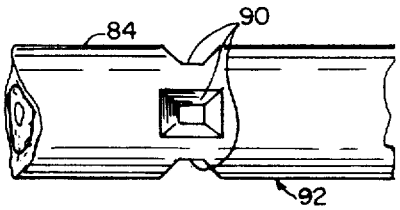

The result as can be seen from FIG. 10B is a truncated, trapezoidal crimp configuration shown at 90 in a portion 92 of a semi-rigid coaxial line.

It is also possible to obtain shunt capacitive reflectors by utilization of any number of crimps or by parallel, straight edges through which the coaxial cable is passed, with the edges brought down to bear on opposite sides of the cable.

While the subject invention has been described for use with "semi-rigid" cable, it is, of course, possible to use coaxial cable with braid assuming that the crimped braid is held in place after crimping by a suitable device such as a "C" clamp (not shown).

Although the subject crimped coaxial delay line has cribed in terms of its function as a dispersive delay line, as will be seen hereinafter, the crimped coaxial line also can be configured to function as a bandpass filter which can be tailored to any desired filter characteristic.

CRIMPED COAXIAL LINE FUNCTIONING AS A BANDPASS FILTER

Figure 11:
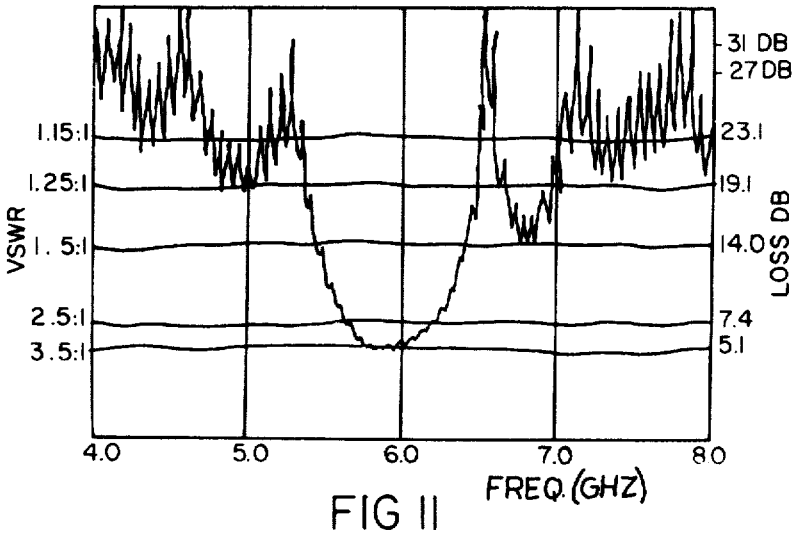
FIG. 11 is a diagram showing a typical filter response when the crimped coaxial cable is configured to function as a bandpass filter.

It will be appreciated that the subject invention has been described in terms of a dispersive delay line in which the delay is a linear function of frequency. The crimped coaxial line may also be configured to function as a bandpass filter. In one embodiment, with equally spaced crimps, the filter has a $$\frac{\sin x}{x}$$

characteristic. Alternatively, with appropriate amplitude weighting, the line can be tailored to a desired bandpass characteristic involving a predetermined sidelobe structure. It will be appreciated that the amplitude weighting is a function of the depth of the crimp. The effect of the depth of the crimp has been hereinbefore described. One typical filter bandpass characteristic for seven equally spaced crimps is illustrated in FIG. 11.

Although preferred embodiments of the invention have been described in considerable detail for illustrative purposes, many modifications will occur to those skilled in the art. It is therefore desired that the protection afforded by Letters Patent be limited only by the true scope of the appended claims.

We claim:

1. A crimped coax reflective broad band dispersive delay line with precisely linear delay vs. frequency characteristics so that the output of said delay line will function as a pulse compression filter when the input to said delay line is linearly fm frequency swept in a manner is matched to the linear delay vs. frequency characteristic of said delay line.

2. A reflective broad band dispersive delay line with precisely linear delay vs. frequency characteristics comprising a length of coaxial cable which is crimped at preselected locations with preselected depths so as to give said coaxial cable a pre-determined linear delay with frequency characteristics, so that the output of said delay line will function as a pulse compression filter when the input to said delay is linearly fm frequency matched to the linear delay vs. frequency characteristic of said delay line.

3. A reflective dispersive delay line having predetermined linear delay with frequency characteristics said delay line comprising:

length of coaxial cable having an inner conductor, insulation and an outer conductive jacket, said jacket being crimped inwardly at a preselected depth towards said inner conductor at preselected locations so as to provide capacitive shunts, said crimps being axially short as compared with the wavelength of any signal to be applied to said line so that the output of said delay line will function as a pulse compression filter when the input to said delay line is linearly fm frequency swept in a manner that is matched to the linear delay vs. frequency characteristic of said delay line.

4. The delay line of claim 3 wherein said locations are chosen such that said delay line is given a dispersive characteristic.

5. A method of providing a coaxial cable reflective broad band delay line with a predetermined linear delay with frequency response characteristic comprising the step of providing said coaxial cable with crimps at preselected locations with preselected depths along the length thereof, said crimps providing capacitive shunts at said preselected locations with selected series of shunts providing for the reflection of a signal at a predetermined frequency so that the output of said delay line will function as a pulse compression filter when the input to said delay line is fm frequency swept in a manner that is matched to the linear delay vs. frequency characteristic of said delay line.

6. Signal compression apparatus comprising:

a length of coaxial cable, said cable being provided with crimps at preselected locations and preselected depths along the length thereof; and terminating means at one end of said coaxial cable, so that the output of said delay line will function as a pulse compression filter when the input to said delay line is linearly fm frequency swept in a manner that is matched to the linear delay vs. frequency characteristic of said delay line.

7. Apparatus for forming simple shunt capacitances along the length of a conventional coaxial cable having an inner conductor, insulation and an outer conductive jacket which is deformable towards said inner conductor said apparatus comprising:

means for deforming said outer jacket and pressing it inwardly towards said inner conductor for a predetermined distance at a predetermined location so as to form a crimp which is axially short as compared with the wavelength of signals applied to said coaxial cable, whereby said coaxial cable will have prescribed linear delay with frequency characteristics that are determined by the distance and location of the crimps on said cable and the output of said delay line will function as a pulse compression filter when the input to said delay line is linearly fm frequency swept in a manner that is matched to the linear delay vs. frequency characteristic of said delay line.

8. The apparatus of claim 7 wherein said deforming means includes a pipecutter-like device which when rotated about the coaxial cable forms an annular depression in said outer jacket at a predetermined depth.

9. The apparatus of claim 7 wherein said deforming means includes a multitude tooth crimping tool having an open and shut position, in wh[illegible] in its open position said coax cable passes betwe[illegible] [illegible]ne ends of said teeth and wherein in its closed position said teeth move in an axial direction towards the inner conductor of said coaxial cable for a predetermined distance so as to deform said jacket.

10. The apparatus of claim 7 wherein said deforming means two parallel opposed blades and means for moving said blades towards and from each other.

11. A reflective broad band delay line comprising:

a length of coaxial cable having an inner conductor insulation and an outer conductive jacket, said jacket being crimped inwardly towards said inner conductor at locations which cause signals of different frequencies propagating in one direction down said line to be reflected back in said line in an opposite direction from different positions along said line so that the output of said delay line will function as a pulse compression filter when the input to said delay line is linearly fm frequency swept in a manner that is matched to the linear delay vs. frequency characteristic of said delay line.

12. A crimped coax reflective broad band delay line, with the crimps causing signals of different frequencies to be reflected by crimps at different locations so that the output of said delay line will function as a pulse compression filter when the input to said delay line is linearly fm frequency swept in a manner that is matched to the linear delay vs. frequency characteristic of said delay line.

* * * * *